US009038616B2

(12) United States Patent
Phillips

(10) Patent No.: US 9,038,616 B2
(45) Date of Patent: May 26, 2015

(54) WATER BALLOON LAUNCHING CANNON AND ASSOCIATED METHODS

(71) Applicant: Michael Phillips, Antelope, CA (US)

(72) Inventor: Michael Phillips, Antelope, CA (US)

( * ) Notice: Subject to any disclaimer, the term of this patent is extended or adjusted under 35 U.S.C. 154(b) by 0 days.

(21) Appl. No.: 13/677,191

(22) Filed: Nov. 14, 2012

(65) Prior Publication Data

US 2013/0316611 A1 Nov. 28, 2013

Related U.S. Application Data

(60) Provisional application No. 61/559,671, filed on Nov. 14, 2011.

(51) Int. Cl.

| | |
|---|---|
| ***A63H 33/00*** | (2006.01) |
| ***A63H 33/18*** | (2006.01) |
| ***A63G 31/00*** | (2006.01) |
| ***F41B 11/89*** | (2013.01) |
| *F41B 11/682* | (2013.01) |

(52) U.S. Cl.
CPC ..... *A63H 33/00* (2013.01); *A63H 33/18* (2013.01); *A63G 31/007* (2013.01); *F41B 11/682* (2013.01); *F41B 11/89* (2013.01)

(58) Field of Classification Search
CPC ..... F41B 7/08; A63B 65/122; A63H 33/00
USPC ..... 124/61, 65–67
See application file for complete search history.

(56) References Cited

U.S. PATENT DOCUMENTS

| | | | | | |
|---|---|---|---|---|---|
| 899,448 | A * | 9/1908 | Grobl | 124/27 |
| 970,018 | A * | 9/1910 | Coleman | 124/27 |
| 2,600,883 | A * | 6/1952 | King | 124/63 |
| 2,633,119 | A * | 3/1953 | Bauderer et al. | 124/27 |
| 2,944,822 | A * | 7/1960 | Brown | 273/405 |
| 2,962,837 | A * | 12/1960 | Lemelson | 446/193 |
| 3,166,321 | A * | 1/1965 | Fleishman | 124/27 |
| 4,086,901 | A * | 5/1978 | Clement | 124/21 |
| 4,922,884 | A * | 5/1990 | Ford | 124/20.1 |
| 5,979,424 | A * | 11/1999 | Alvarez et al. | 124/16 |
| 6,953,033 | B2 * | 10/2005 | Vanek et al. | 124/16 |
| 6,972,774 | B2 * | 12/2005 | Eguchi | 345/629 |
| 7,448,371 | B2 * | 11/2008 | Sapir | 124/16 |
| 7,721,722 | B1 * | 5/2010 | Tulkis | 124/73 |
| 7,789,080 | B2 * | 9/2010 | Fielding, Jr. | 124/27 |
| 8,393,299 | B1 * | 3/2013 | Bernat | 119/702 |

* cited by examiner

*Primary Examiner* — Michael David

(57) ABSTRACT

A water balloon launching cannon is disclosed. The water balloon launching cannon includes a slotted barrel for rapid and easy loading and uses compressed air as the propelling force for firing the water balloon. Namely, the water balloon launching cannon includes an I-beam support upon which is mounted an air delivery system and the slotted barrel. For ease of disassembly, (1) the air delivery system includes quick-release mechanisms and (2) a plunger assembly inside the barrel is held by an easily removable pin. Further, a method of operating and a method using the water balloon launching cannon are disclosed.

1 Claim, 16 Drawing Sheets

WATER BALLOON LAUNCHING CANNON AND ASSOCIATED METHODS

RELATED APPLICATIONS

This application claims the priority of U.S. Provisional Patent Application Publication No. 61/559,671, filed Nov. 14, 2011, entitled "Balloon Battles Water Balloon Launching Cannon."

TECHNICAL FIELD

The present disclosure relates generally to amusement devices, and more particularly to a water balloon launching cannon and associated methods.

BACKGROUND

A variety of water balloon launching devices exist today for the amusement of children and adults. These devices have configurations ranging from slings to slingshots, and from lacrosse rackets to jai-alai cestas. All of these devices are effective at hurling a water balloon farther than human factors would naturally permit. However, these configurations rely on human strength as the propelling force of the water balloon, which is limited. In addition to human-powered water balloon launching devices, automated water balloon launching devices exist. However, a drawback of current automated water balloon launching devices is that they are unreliable. For example, a common failure is that the water balloon bursts during the launching process. Namely, the water balloon bursts while still inside of the barrel of the water balloon-launching device, which causes the user to reload and make another attempt to fire the water balloon launching device.

BRIEF DESCRIPTION OF DRAWINGS

Various inventive embodiments disclosed herein, both as to its organization and manner of operation, together with further objectives and advantages, may be best understood by reference to the following description, taken in connection with the accompanying drawings as set forth below.

DETAILED DESCRIPTION

A water balloon launching cannon and associated methods are provided. The water balloon launching cannon includes a slotted barrel for rapid and easy loading and uses compressed air as the propelling force of the water balloon. The water balloon launching cannon is an automated water balloon launching device that exhibits advantages over conventional water balloon launching devices in that it is easy to use and reliable. Namely, the slotted barrel and a plunger assembly inside the slotted barrel that is powered by compressed air are designed to launch the water balloon in a manner that reduces, preferably entirely eliminates, the possibility of the water balloon bursting during the launching process as compared with conventional water balloon launching devices.

Figure 1:
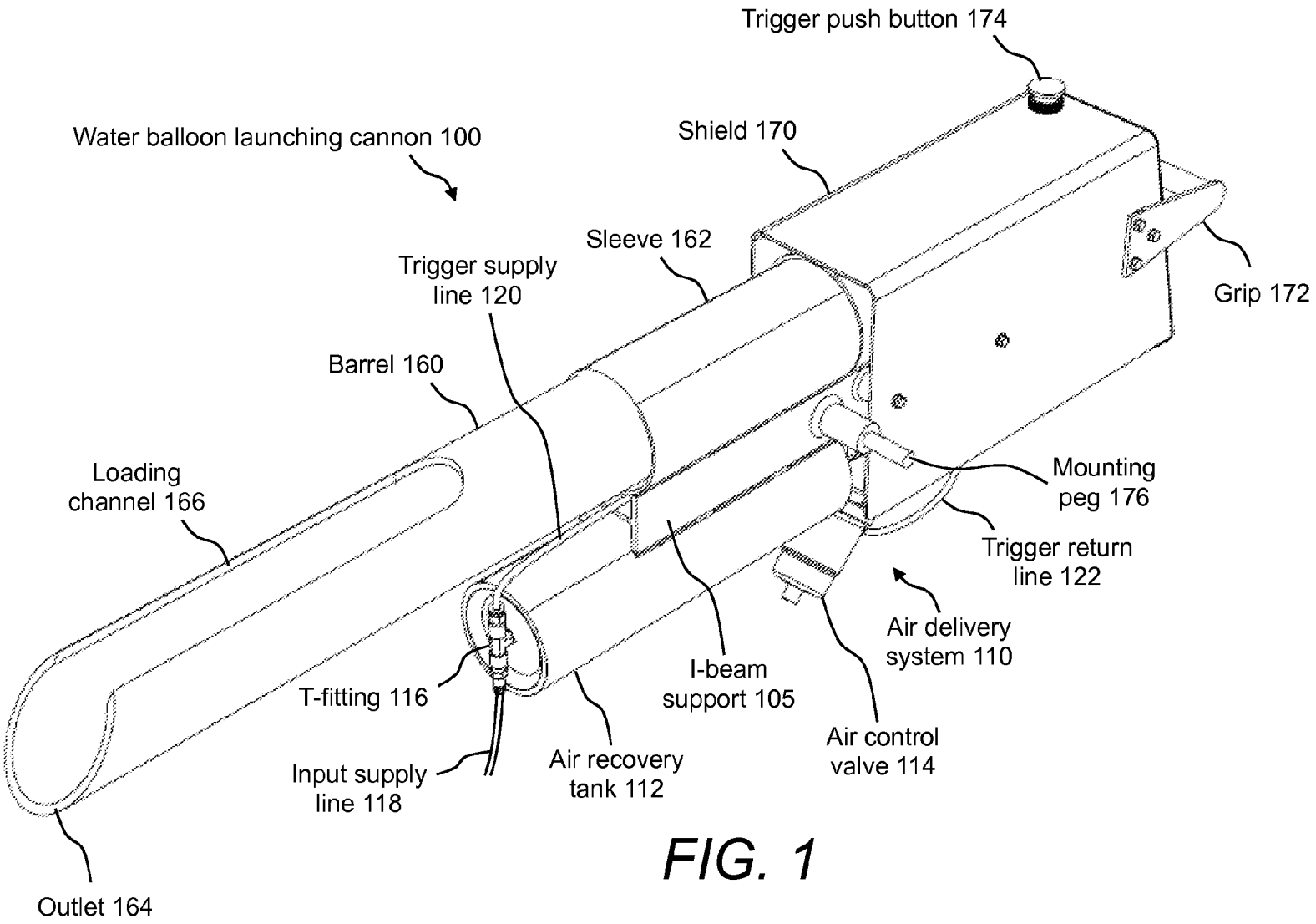
FIGS. 1, 2, and 3 illustrate an isometric view, a top down view, and a side view, respectively, of an example of a water balloon launching cannon.
Figure 2:
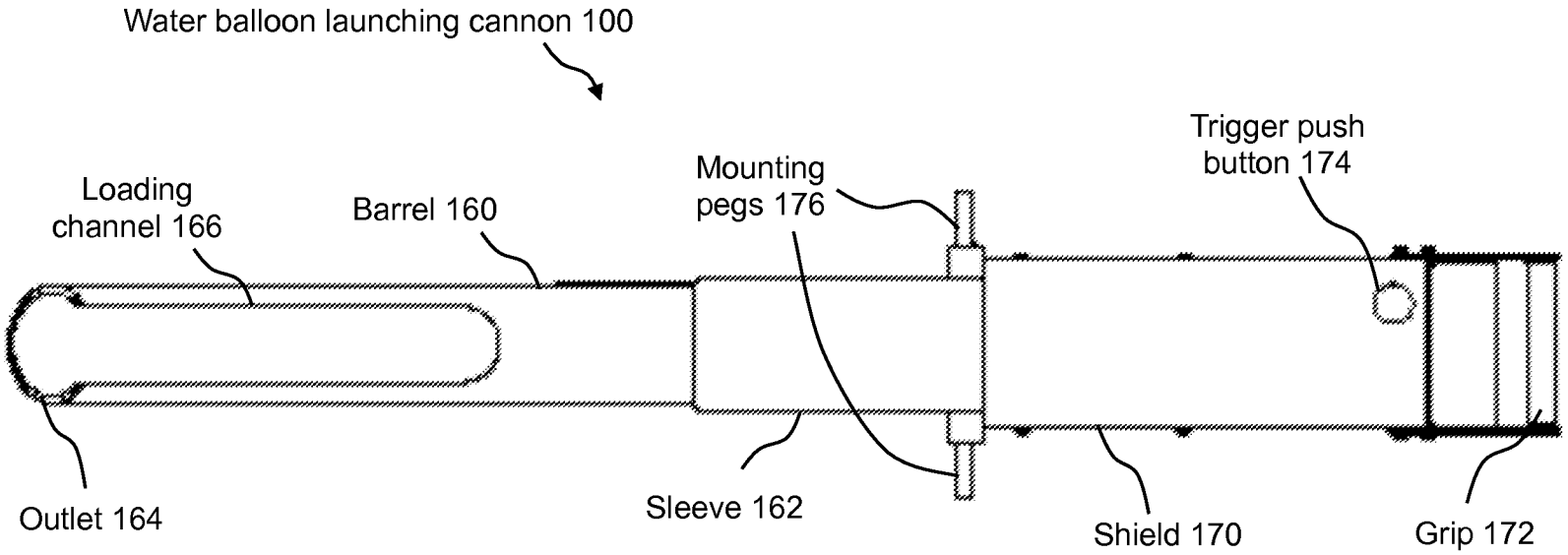
Figure 3:
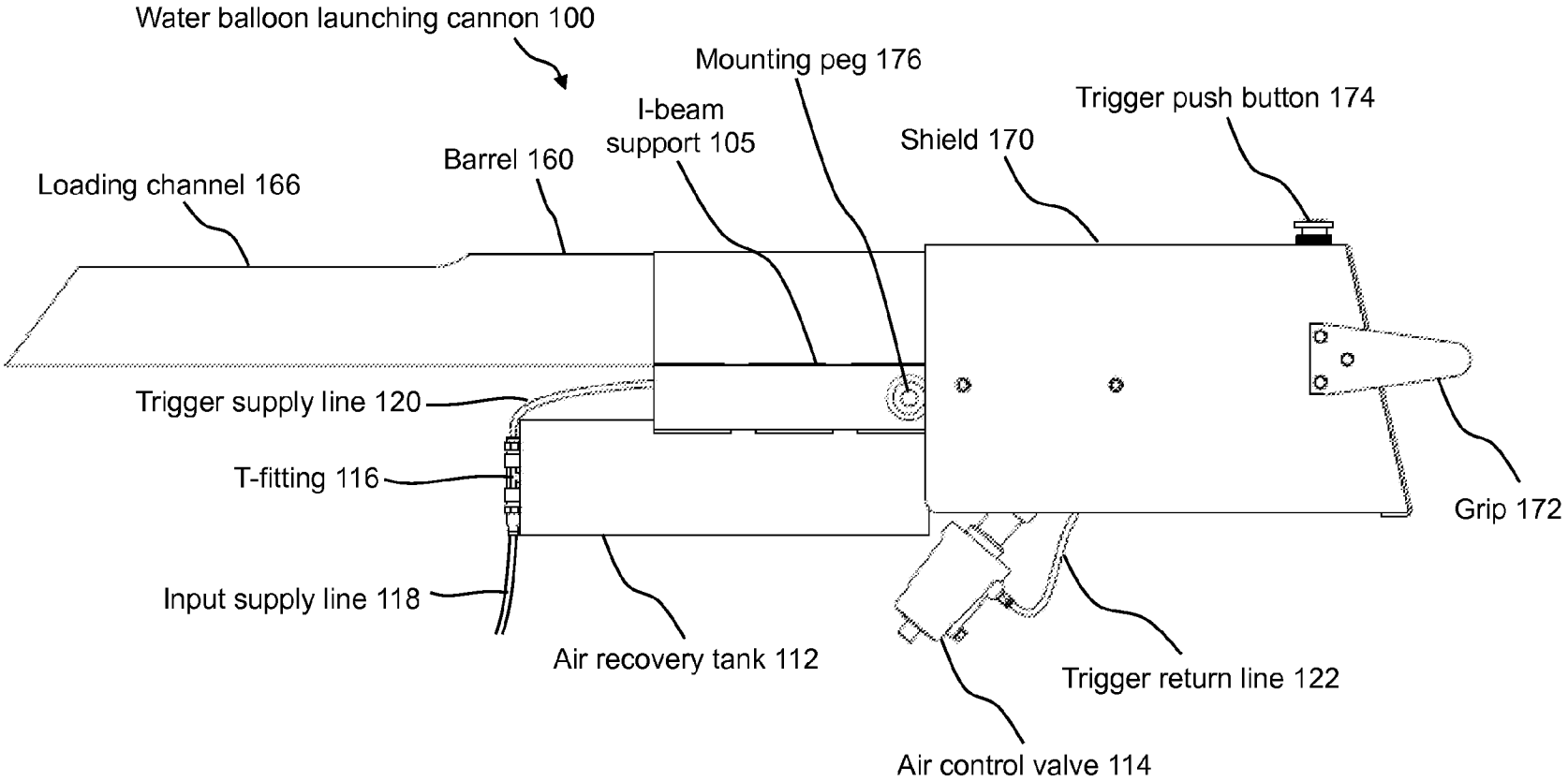

FIGS. 1, 2, and 3 illustrate an isometric view, a top down view, and a side view, respectively, of an example of a water balloon launching cannon 100. In this example, the water balloon launching cannon 100 includes an I-beam support 105 upon which is mounted an air delivery system 110 and a barrel 160. The I-beam support 105 provides the primary structural support for the water balloon launching cannon 100. The I-beam support 105 is formed, for example, of plastic or metal (e.g., aluminum or stainless steel). For an I-beam support 105 being formed of plastic, an example of the specifications is as follows. The length of the plastic I-beam support 105 is from about 12 inches to about 24 inches in one example, or about 18 inches in another example. It will be appreciated that the dimensions may be chosen according to the application.

The air delivery system 110 is pneumatically coupled to one end of the barrel 160. A shield 170 is provided around the air delivery system 110. A grip 172 is provided on the shield 170 at the rear-most portion of the water balloon launching cannon 100. Additionally, FIGS. 1, 2, and 3 show a trigger push button 174 protruding through the shield 170 in a location that is convenient to the user. The trigger push button 174 is used for firing the water balloon launching cannon 100.

The air delivery system 110 further includes an air recovery tank 112, an air control valve 114, and various other valves, flanges, couplers, fittings, and supply/return lines, which are shown and described with reference to FIGS. 7, 8, and 9.

The air delivery system 110 provides a source of pressurized air for driving a plunger assembly (shown in FIG. 5) that is inside of the barrel 160, wherein the plunger assembly is what pushes against the water balloon and propels the water balloon out of the barrel 160. The amount of air pressure that the air delivery system 110 supplies to the barrel 160 and more particularly to the plunger assembly is from about 70 psi to about 80 psi in one example, or about 75 psi in another example. Therefore, the air recovery tank 112 is designed to be charged with compressed air to from about 70 psi to about 80 psi. The air recovery tank 112 is, for example, a 1-gallon air recovery tank that is formed of a non-corrosive material, such as plastic, aluminum, or stainless steel. An external air compressor (not shown) supplies an input port of the air recovery tank 112 via a T-fitting 116. The external air compressor is, for example, a 15-gallon gas-powered or electric-powered air compressor that can supply a working pressure of at least about 100 psi. The external air compressor can be, for example, any commercially available air compressor. An input supply line 118 from the external air supply feeds the T-fitting 116. The T-fitting 116 then distributes the air supply to the air recovery tank 112 as well as to a trigger (shown in FIGS. 7, 8, and 9) via a trigger supply line 120. A trigger return line 122 is provided between the trigger (shown in FIGS. 7, 8, and 9) and the air control valve 114.

An aspect of the water balloon launching cannon 100 is that the amount of air pressure that is delivered to the barrel 160 for launching an air balloon is low enough to avoid causing the balloon to burst before exiting the barrel 160, while at the same time high enough to ensure an acceptable launching distance. In one example, the launching distance is about 60 feet.

The air control valve 114 is the main airflow control valve of the air delivery system 110. In one example, the air control valve 114 is a 1-inch, stainless steel, single-acting, NPT pneumatic valve.

The barrel 160 is a hollow tube that is formed, for example, of plastic (e.g., acrylonitrile butadiene styrene (ABS) or polyvinyl chloride (PVC)) or metal (e.g., aluminum or stainless steel). The diameter of the barrel 160 is sized to hold a water balloon. The length of the barrel 160 is sized to provide a certain accuracy of the launched water balloon. The diameter of the barrel 160 is from about 3 inches to about 5 inches in one example, or about 4 inches in another example. The length of the barrel 160 is from about 40 inches to about 30 inches in one example, or about 36 inches in another example.

A sleeve 162 is affixed to the I-beam support 105 for holding the barrel 160. For example, the sleeve 162 is affixed to the I-beam support 105 by an adhesive or by welding. Namely, the barrel 160 slides through the sleeve 162 and is held in place by the sleeve 162.

The barrel 160 has an outlet 164, which is the end of the barrel 160 from which a water balloon is launched. The outlet 164 of the barrel 160 may be cut at an angle. In one example, the outlet 164 is cut at a 30-degree angle. The barrel 160 further includes a loading channel 166, which is slot that is located on the top of the barrel 160 when the water balloon launching cannon 100 is in use. The loading channel 166 begins at the edge of the outlet 164 and runs along the length of the barrel 160. The width of the loading channel 166 is from about 2.5 inches to about 3.5 inches in one example, or about 3 inches in another example. The length of the loading channel 166 is from about 12 inches to about 18 inches in one example, or about 15 inches in another example.

The loading channel 166 is the balloon loading slot, meaning that the user loads the water balloon launching cannon 100 by dropping a water balloon into the loading channel 166. However, in another embodiment, the barrel 160 does not include the loading channel 166. Instead, the water balloon is loaded through the outlet 164. With the outlet 164 of the barrel 160 tilted slightly upward, once loaded the water balloon will move by gravity against a plunger (shown and described with reference to FIGS. 6 through 15) that is inside the barrel 160. When a balloon is launched, it expands to the size of the barrel 160 as it travels along the barrel 160. Therefore, there can be no sharp or pointed features along the barrel 160 that could cause the balloon to burst during the launching process. Accordingly, the edges of the outlet 164 and of the loading channel 166 are chamfered, beveled, or rounded.

The shield 170 provides a protective shield around the air delivery system 110. For example, the shield 170 is formed of an arrangement of four plates—a top plate, two side plates, and a back plate. The shield 170 is formed, for example, of plastic or metal (e.g., aluminum or stainless steel). The trigger push button 174 protrudes through an opening in, for example, the top plate of the shield 170. The grip 172 is formed, for example, of plastic or metal (e.g., aluminum or stainless steel). The grip 172 is mechanically coupled to the shield 170. The grip 172 is a handle that the user may grasp when using the water balloon launching cannon 100. More particularly, the grip 172 is used for aiming the water balloon launching cannon 100. For aesthetic purposes, the outer surfaces of the barrel 160, the shield 170, and grip 172 may be painted, textured, or otherwise patterned with any colors and/or designs.

The water balloon launching cannon 100 also includes a pair of mounting pegs (or rods or bars) 176. Namely, one mounting peg 176 is arranged on one side of the I-beam support 105 while another mounting peg 176 is arranged on the other side of the I-beam support 105 in an opposing fashion as shown in FIG. 2. The mounting pegs 176 serve as a pivot point when the water balloon launching cannon 100 is installed in a mounting base, an example of which is shown with reference to FIG. 4 below.

Figure 4:
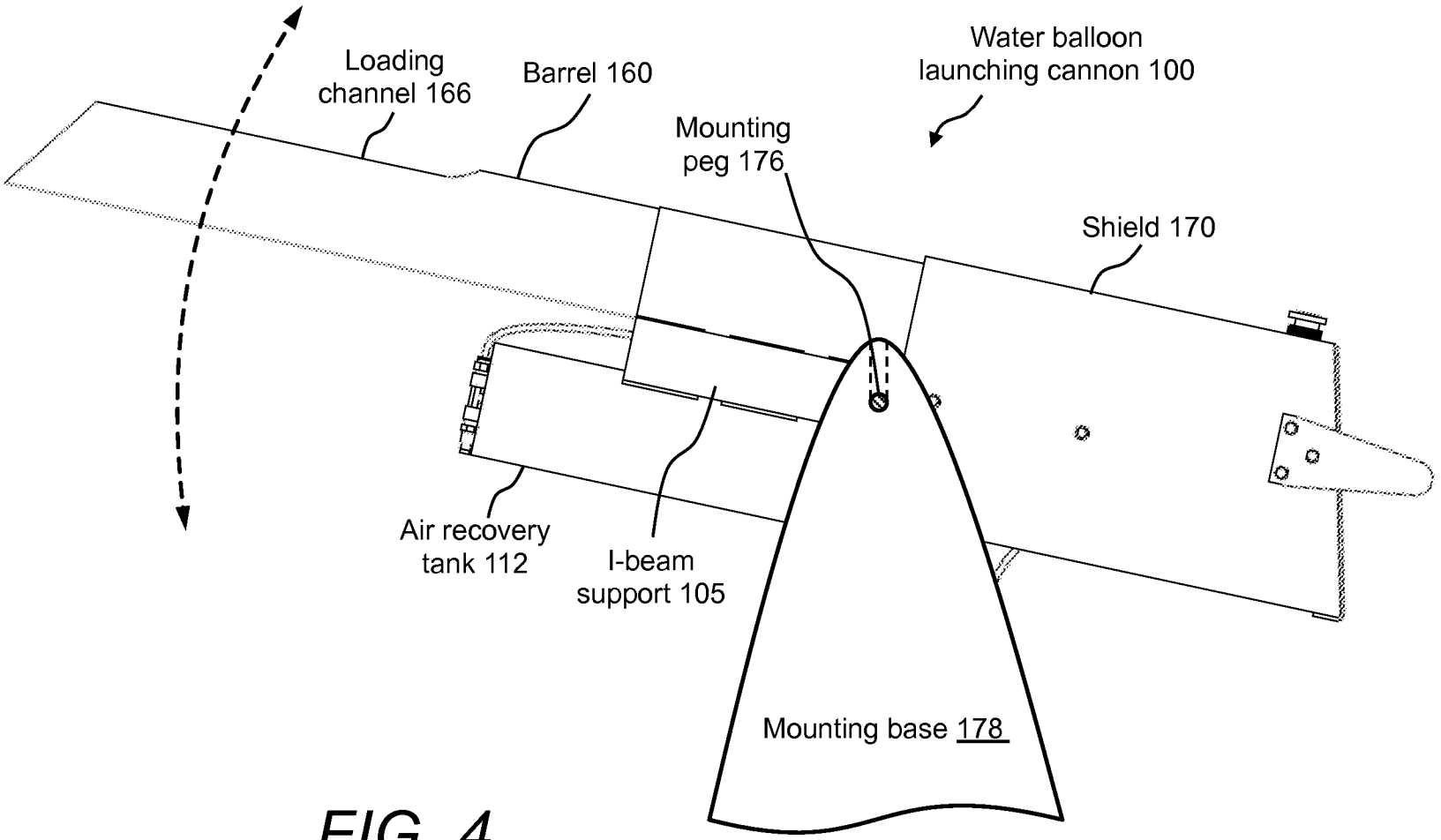
FIG. 4 illustrates a side view of the water balloon launching cannon installed in a mounting base.

FIG. 4 illustrates a side view of the water balloon launching cannon 100 installed in a mounting base 178. The mounting base 178 is a mounting base or frame that includes, for example, two plates, two bars, or two of any type of supports, which are arranged on either sides of the water balloon launching cannon 100. The water balloon launching cannon 100 is fitted into the mounting base 178 and the two mounting pegs 176 are rotatably fitted into corresponding holes, slots, detents, or notches in the two plates, two bars, or two of any type of supports, respectively, of mounting base 178. When in use, the mounting base 178 is a substantially stationary and stable mounting base. The pivot point created by mounting pegs 176 and mounting base 178 allows the water balloon launching cannon 100 to swivel laterally, which allows the user to move the outlet 164 of the barrel 160 up and down and thereby aim the water balloon launching cannon 100. The water balloon launching cannon 100 is not limited to mechanisms, such as mounting pegs 176, that allow a lateral swivel only. The water balloon launching cannon 100 can include mechanisms that allow a lateral swivel, a horizontal swivel, or both a lateral and horizontal swivel.

Figure 5A:
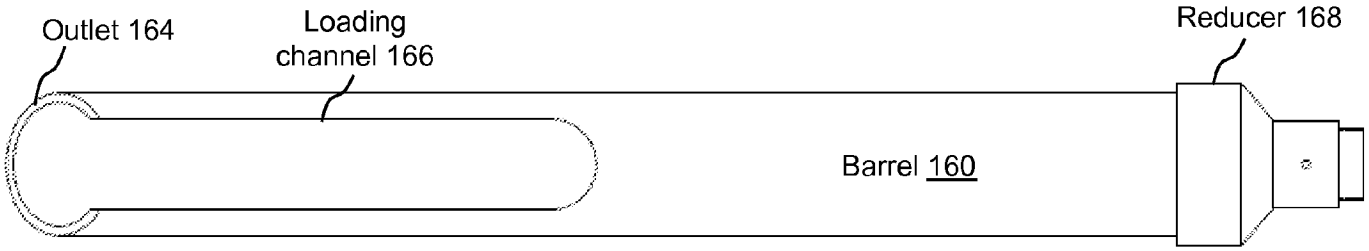
FIGS. 5A, 5B, and 5C illustrate a top view, a side view, and a cross-sectional view, respectively, of a barrel of the water balloon launching cannon.
Figure 5B:
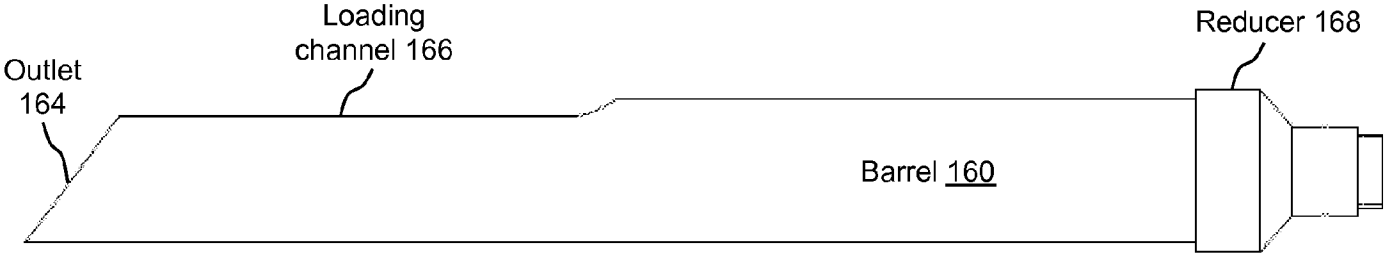
Figure 5C:
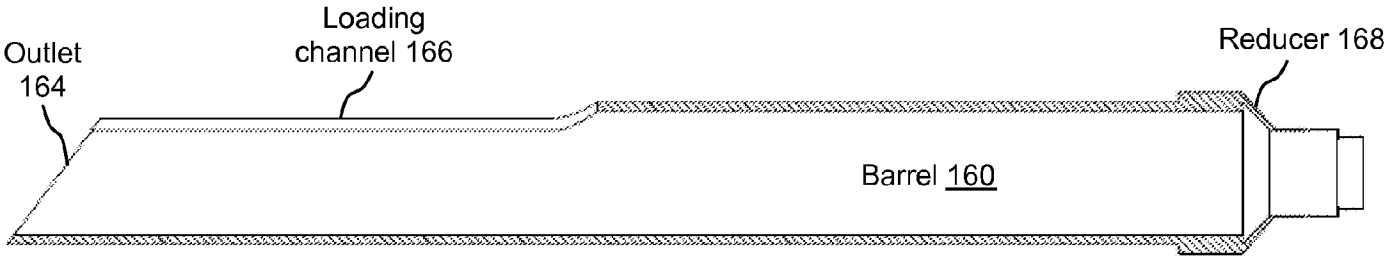

FIGS. 5A, 5B, and 5C illustrate a top view, a side view, and a cross-sectional view, respectively, of the barrel 160 of the water balloon launching cannon 100. FIGS. 5A, 5B, and 5C show that the barrel 160 includes the loading channel 166 near the outlet 164. A reducer 168 is installed on the end of the barrel 160 opposite the outlet 164. The reducer 168 is for pneumatically coupling the air delivery system 110 to the barrel 160. The reducer 168 can be coupled to the barrel 160 by, for example, threading or gluing. In one example, if the diameter of the barrel 160 is 4 inches, then the reducer 168 is a 4 inch-to-2 inch reducer fitting.

Figure 6A:
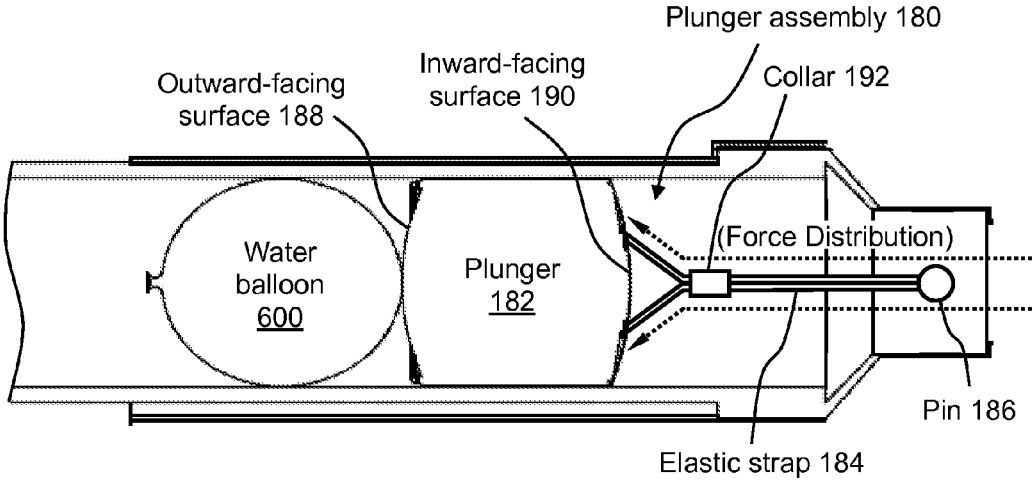
FIGS. 6A and 6B illustrate a top down view and a side view, respectively, of an example of a plunger assembly that is inside the barrel of the water balloon launching cannon.
Figure 6B:
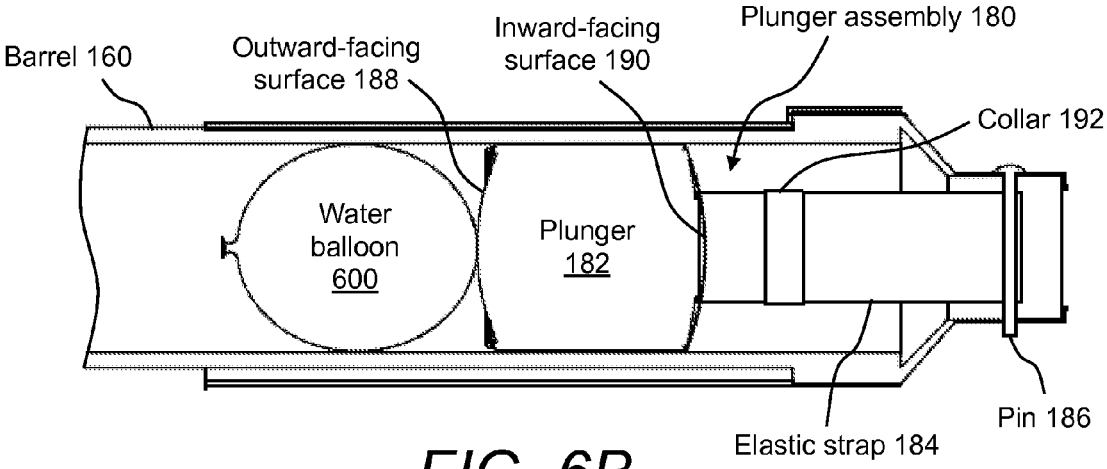

FIGS. 6A and 6B illustrate a top down view and a side view, respectively, of an example of a plunger assembly 180 that is inside of the barrel 160 of the water balloon launching cannon 100. In this example, the plunger assembly 180 includes a plunger 182 that is secured to the reducer 168 of the barrel 160 via an elastic strap 184. More particularly, one end of the elastic strap 184 is secured to the plunger 182 while the other end of the elastic strap 184 is secured to the reducer 168 via a pin 186 as shown in FIGS. 6A and 6B. FIGS. 6A and 6B also show a water balloon 600 inside of the barrel 160 and in relation to the plunger assembly 180. The water balloon 600 is representative of any water balloon to be launched using the water balloon launching cannon 100. In one example, the water balloon 600 is about a 12-inch round balloon that is filled with about 24 fluid ounces of water.

The plunger 182 has an outward-facing surface 188 and an inward-facing surface 190. Namely, the outward-facing surface 188 is the surface of the plunger 182 that comes into contact with the water balloon 600 during the launching process, while the inward-facing surface 190 is the surface of the plunger 182 that is secured to the elastic strap 184. In one example, the plunger 182 is formed of a low-density foam that is enclosed in a vinyl covering that has a lacquer coating thereon. As such, the outward-facing surface 188 is a soft, deformable, vinyl surface that comes into contact with the water balloon 600. Namely, when the outward-facing surface 188 of the plunger 182 impacts the water balloon 600 during the launching process, the outward-facing surface 188 deforms to the shape of the water balloon 600 while propelling the water balloon 600 forward. The degree of deformation of the outward-facing surface 188 of the plunger 182 can be, for example, about 1 inch. In one example, the elastic strap 184 is about 2 inches wide, is about 8 inches long when in the relaxed state, and has a stretch rating of about 50%.

Referring now to FIG. 6A, the elastic strap 184 is wrapped around the pin 186 such that the elastic material is doubled. A collar 192 is provided around the doubled elastic material and then the two ends of the elastic material are spaced apart (as shown in FIG. 6A) and secured, for example, by stitching to the inward-facing surface 190 of the plunger 182. The manner in which the elastic strap 184 is attached to the plunger 182 helps to distribute the force of the compressed air evenly to the plunger 182, which lends to a long-lasting reliable plunger 182. Without this manner of force distribution, the force of the air pressure can be damaging to plunger 182 and shorten its lifetime. Additionally, because the elastic strap 184 is elastic, it absorbs much of the force of the air pressure, like a shock absorber, whereas a non-elastic strap would likely rip from the plunger.

A safety aspect of the water balloon launching cannon 100 is that if the elastic strap 184 were to fail (i.e., break) during the launching process, the plunger 182 will likely be shot out of the barrel 160. However, because the plunger 182 is formed of a soft lightweight material it poses little to no threat of harm if a person were to be inadvertently struck with the plunger 182. By contrast, this would not be the case if the plunger 182 were formed of a hard rigid material.

The driving force of the plunger 182 is a burst of momentary air pressure that originates from the air delivery system 110. In the absence of the burst of air, the elastic strap 184 is in its relaxed state and retracts the plunger 182 into the ready state inside of the barrel 160. However, during the launching process, because the elastic strap 184 is stretchable, the plunger 182 is propelled forward when the burst of momentary air pressure occurs. If the elastic strap 184 is about 8 inches long in the relaxed state and has a stretch rating of about 50%, then the distance of travel of the plunger 182 during the launching process is about 4 inches. The plunger 182 is slidably but snugly fitted into the barrel 160. In this way, a seal is maintained between the plunger 182 and the inner walls of the barrel 160, which allows a certain amount of air pressure to build up behind the plunger 182 during the launching process. More details of a process of launching a water balloon using the plunger assembly 180 are described with reference to FIGS. 10 through 16.

Another aspect of the water balloon launching cannon 100 is that, during the launching process, the softness of and the deforming action of the outward-facing surface 188 of the plunger 182 helps to ensure that the water balloon 600 does not burst upon impact, and therefore helps to ensure a successful launch.

Figure 7:
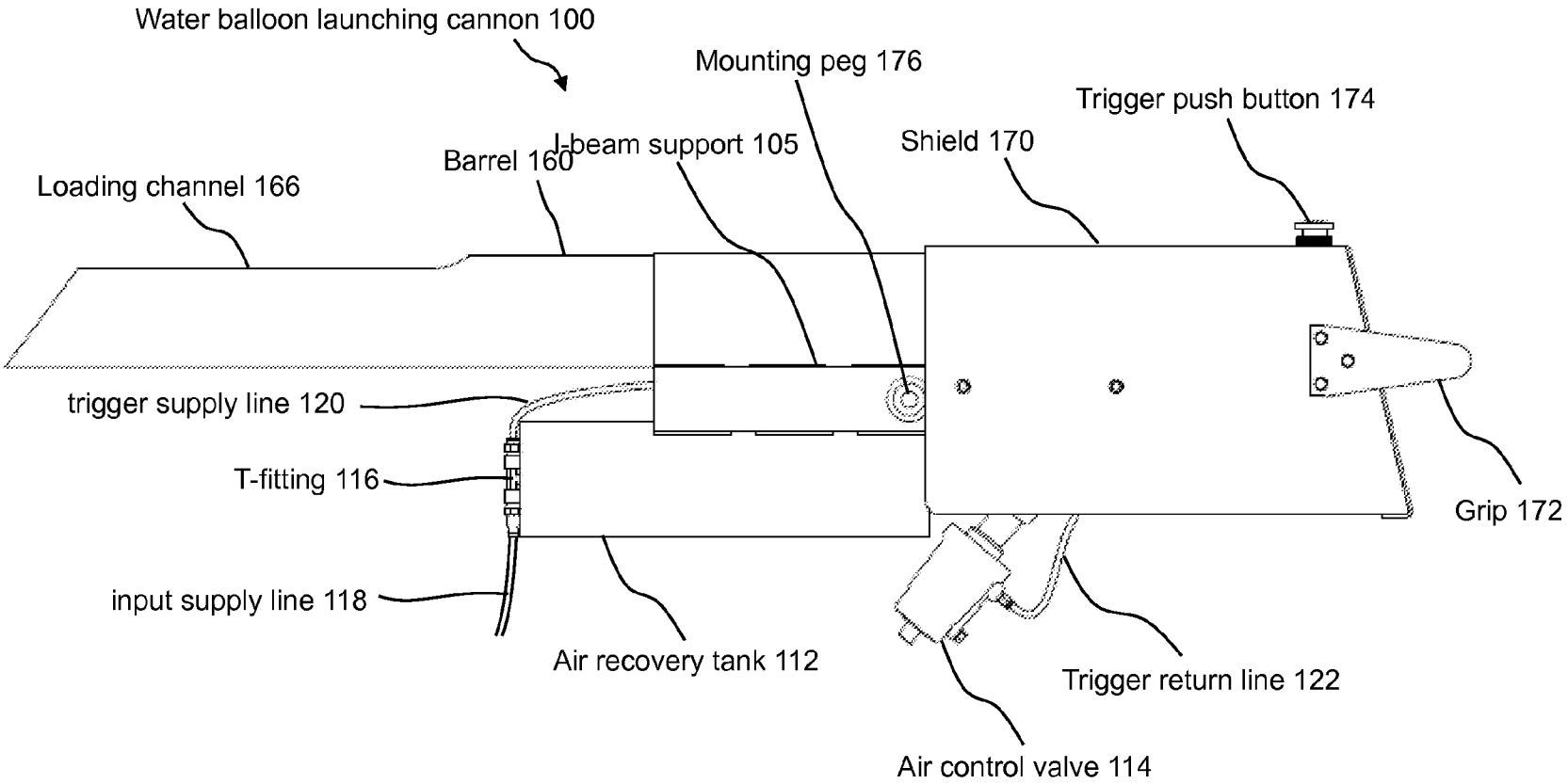
FIGS. 7, 8, and 9 illustrate a cross-sectional view, an exploded side view, and an exploded cross-sectional view, respectively, of the water balloon launching cannon, showing more details thereof and more particularly showing more details of an air delivery system.
Figure 8:
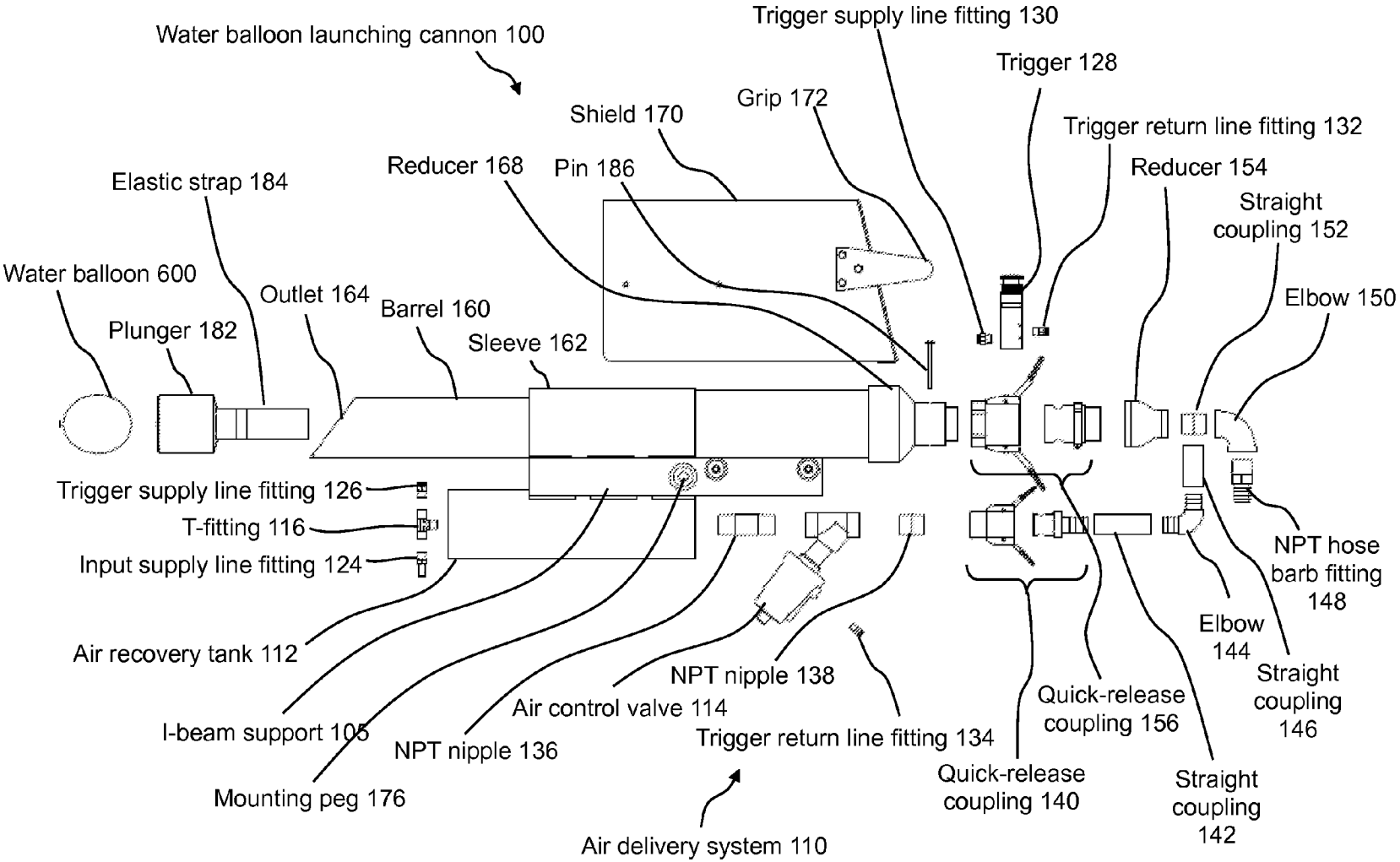
Figure 9:
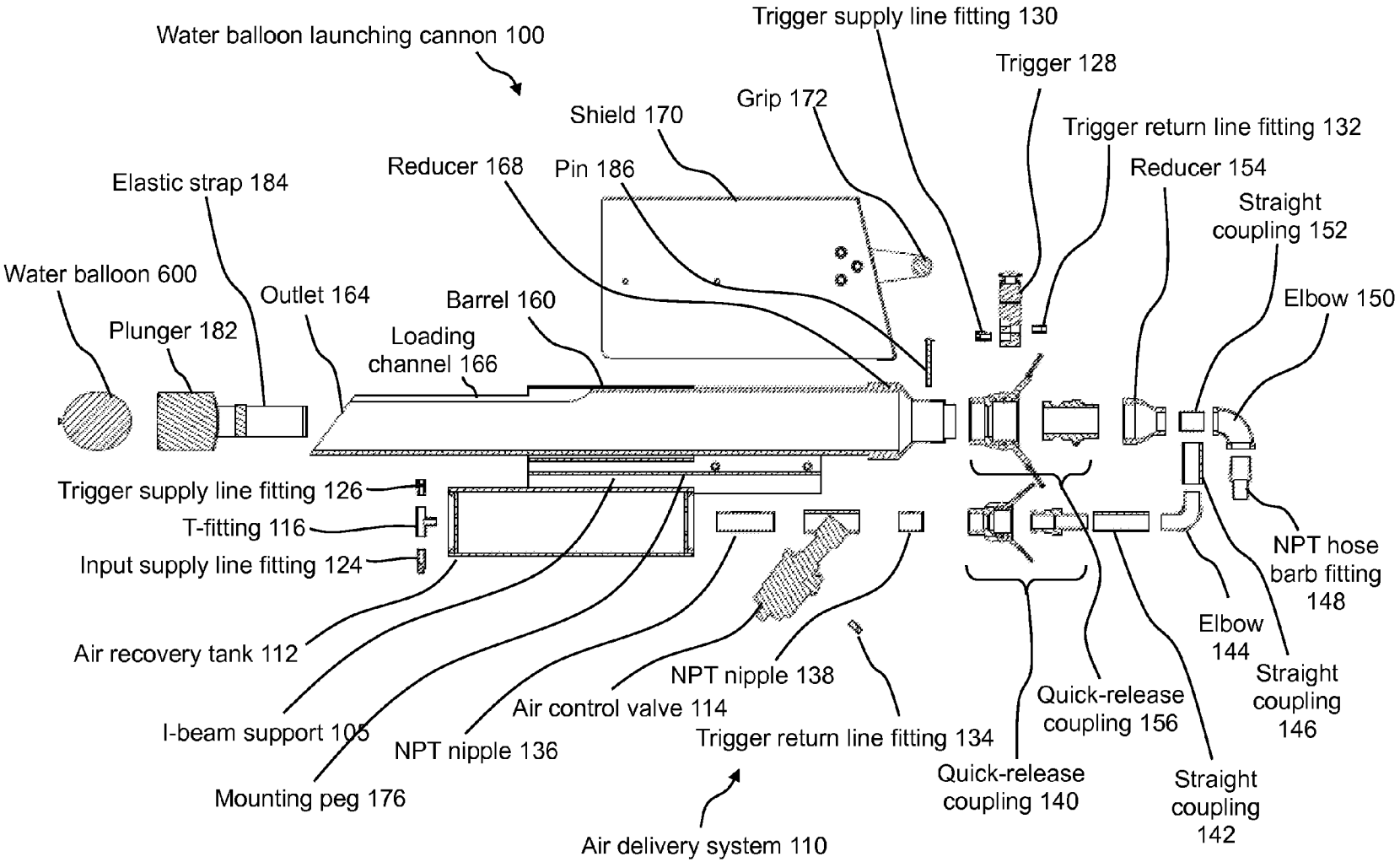

FIGS. 7, 8, and 9 illustrate a cross-sectional view, an exploded side view, and an exploded cross-sectional view, respectively, of the water balloon launching cannon 100, showing more details thereof and more particularly showing more details of the air delivery system 110.

The air delivery system 110 includes the air recovery tank 112, the air control valve 114, the T-fitting 116, the input supply line 118, the trigger supply line 120, and the trigger return line 122 as described with reference to FIGS. 1, 2, and 3. However, referring now to FIGS. 7, 8, and 9, the air delivery system 110 further includes an input supply line fitting 124 for coupling the input supply line 118 to the T-fitting 116 and a trigger supply line fitting 126 for coupling the trigger supply line 120 to the T-fitting 116. The air delivery system 110 yet further includes a trigger 128. Accordingly, the air delivery system 110 includes a trigger supply line fitting 130 for coupling the trigger supply line 120 to the trigger 128 and a trigger return line fitting 132 for coupling the trigger return line 122 to the trigger 128. Additionally, the air delivery system 110 includes a trigger return line fitting 134 for coupling the trigger return line 122 to the air control valve 114.

In one example, the input supply line 118, the trigger supply line 120, and the trigger return line 22 are comprised of 0.25-inch flexible tubing. In this example, the T-fitting 116, the input supply line fitting 124, the trigger supply line fitting 126, the trigger supply line fitting 130, the trigger return line fitting 132, and the trigger return line fitting 134 are 0.25-inch treaded fittings.

The trigger 128 is, for example, a pneumatic momentary switch or valve that is used to trigger the air control valve 114. Another safety aspect of the water balloon launching cannon 100 is it includes pneumatic components (e.g., the air control valve 114 and the trigger 128) that operate using compressed air and does not include components that require electric power.

In air delivery system 110, an airflow path is provided between the air recovery tank 112 and the barrel 160. Starting at the outlet of the air recovery tank 112, the components of this airflow path include, in order, an NPT nipple 136, the air control valve 114, an NPT nipple 138, a quick-release coupling 140, a straight coupling 142, a 90-degree elbow 144, a straight coupling 146, a NPT hose barb fitting 148, a 90-degree elbow 150, a straight coupling 152, a reducer 154, a quick-release coupling 156, and the reducer 168.

In one example, the NPT nipple 136, the air control valve 114, the NPT nipple 138, the quick-release coupling 140, the straight coupling 142, the 90-degree elbow 144, the straight coupling 146, the NPT hose barb fitting 148, the 90-degree elbow 150, and the straight coupling 152 are or include 1-inch fittings. For example, the NPT nipple 136 is a 1-inch, stainless steel, threaded nipple that is 3 inches long; the NPT nipple 138 is a 1-inch, stainless steel, threaded nipple that is 1 inch long; the quick-release coupling 140 a 1-inch, ABS or PVC, camlock quick-release coupling with a hose barb fitting; the straight coupling 142 is 1-inch, high-pressure rated, rubber tubing; the 90-degree elbow 144 is a 1-inch, galvanized steel, 90-degree, hose barb fitting; the straight coupling 146 is 1-inch, high-pressure rated, rubber tubing; the NPT hose barb fitting 148 is a 1-inch NPT nipple-to-1 -inch hose barb fitting; the 90-degree elbow 150 is a 1-inch, galvanized steel, threaded elbow; and the straight coupling 152 is a 1-inch, galvanized steel, threaded straight fitting. The reducer 154 is a galvanized steel, 2 inch-to-1 inch reducer fitting. The quick-release coupling 156 is a 2-inch, ABS or PVC, camlock quick-release coupling. The reducer 168 is an ABS or PVC, 4 inch-to-2 inch reducer fitting.

In the water balloon launching cannon 100 and referring now to FIGS. 1 through 9, the mechanical interconnections between the I-beam support 105, the air recovery tank 112, the barrel 160, the shield 170, and the grip 172 may be by any conventional means, such as, but not limited to, by using screws, bolts, pins, snap features, welds, adhesives, and any combinations thereof. Additionally, the plunger 182 is essentially a consumable item, therefore the quick-release components allow easy access to and replacement of the plunger 182. For example, by using the quick-release coupling 140 and the quick-release coupling 156 to disassemble a portion of the air delivery system 110 and then removing the pin 186, the plunger 182 can be easily replaced.

Figure 10:
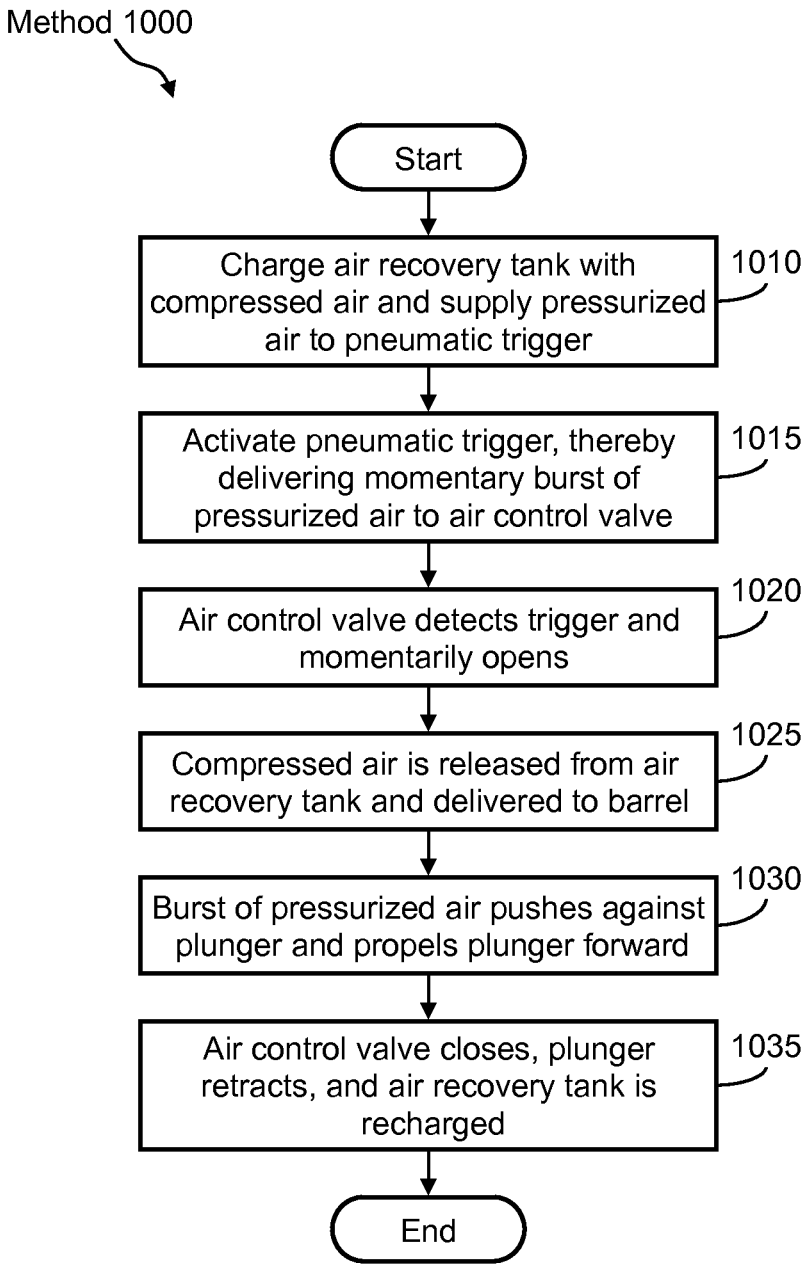
FIG. 10 illustrates a flow diagram of an example of a method of operating the water balloon launching cannon.

FIG. 10 illustrates a flow diagram of an example of a method 1000 of operating the water balloon launching cannon 100. The method 1000 includes, but is not limited to, the following steps.

At a step 1010, the air recovery tank 112 is charged with compressed air. For example, using an external air compressor that supplies the air recovery tank 112, the air recovery tank 112 is charged with compressed air to from about 70 psi to about 80 psi. The same external air compressor also supplies pressurized air to the trigger 128, which is a pneumatic momentary switch that is used to trigger the air control valve 114.

At a step 1015, by pressing the trigger push button 174, the trigger 128 is activated and a momentary burst of pressurized air is delivered from the trigger 128 to the air control valve 114.

At a step 1020, the air control valve 114 detects the burst of pressurized air from the trigger 128 and the air control valve 114 momentarily opens.

At a step 1025, when the air control valve 114 momentarily opens, compressed air is released from the air recovery tank 112, passes through the airflow path of air delivery system 110, and a burst of pressurized air is delivered to the barrel 160.

At a step 1030, the burst of pressurized air enters the barrel 160 and pushes against the plunger 182 and propels the plunger 182 forward. Namely, due to the force of the pressurized air, the plunger 182 is propelled toward the outlet 164 of the barrel 160, restricted only by the limits of the elastic strap 184.

At a step 1035, the activation cycle of the air control valve 114 completes and therefore the air control valve 114 closes, the elastic strap 184 retracts the plunger 182 to its ready state inside the barrel 160, and the air recovery tank 112 is recharged with compressed air in preparation for the next firing cycle.

Figure 11:
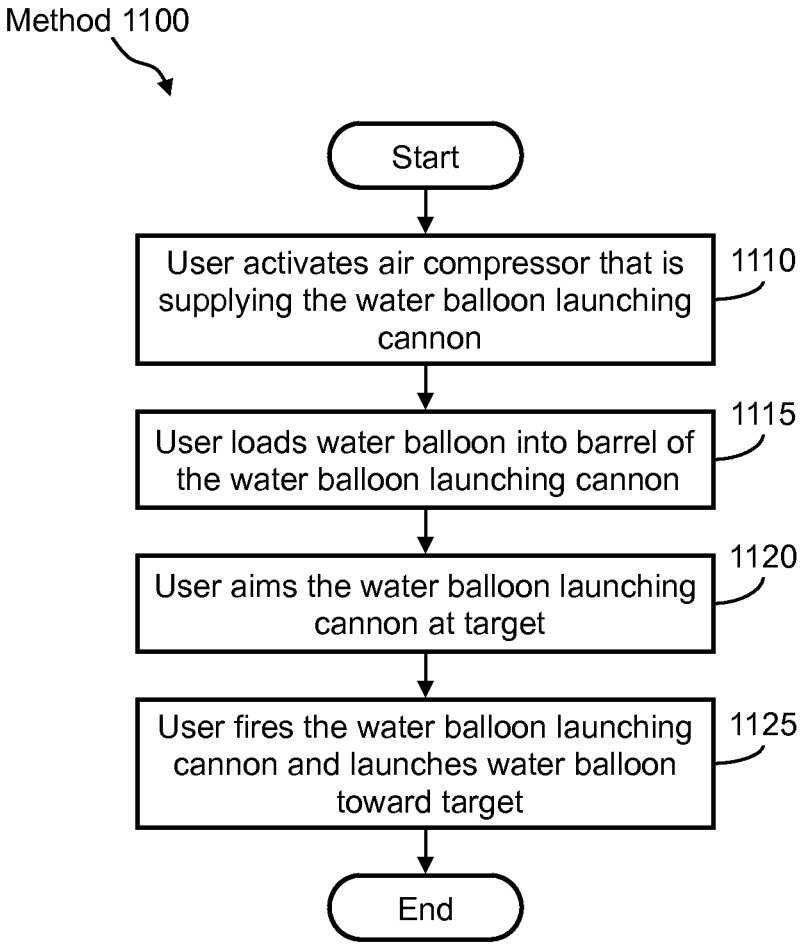
FIG. 11 illustrates a flow diagram of an example of a method of using the water balloon launching cannon.

FIG. 11 illustrates a flow diagram of an example of a method 1100 of using the water balloon launching cannon 100. The method 1100 includes, but is not limited to, the following steps.

At a step 1110, the user activates the external air compressor that is supplying the water balloon launching cannon 100.

Figure 12:
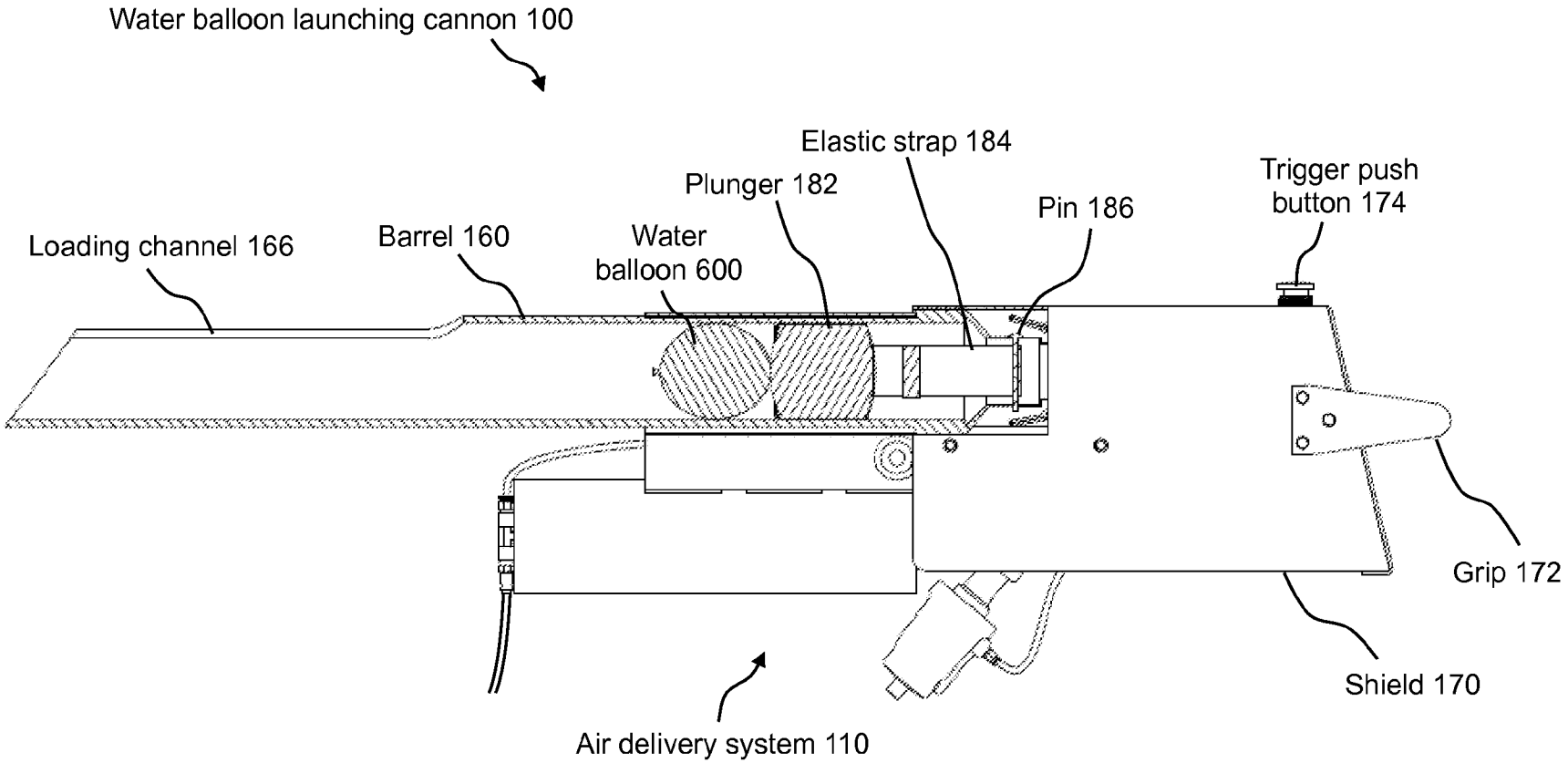
FIGS. 12, 13, 14, and 15 illustrate side views of the water balloon launching cannon and show a process of launching a water balloon.

At a step 1115, the user loads a water balloon, such as the water balloon 600, into the barrel 160 of the water balloon launching cannon 100. Namely, the user tilts the outlet 164 of the barrel 160 slightly upward from horizontal and drops a water balloon through the loading channel 166 of the barrel 160. In one example, the water balloon is about a 12-inch round balloon that is filled with about 24 fluid ounces of water. Once loaded, the water balloon will move by gravity into firing position against the plunger 182. By way of example, FIG. 12 illustrates a side view of the water balloon launching cannon 100 in which the water balloon 600 is in the firing position against the outward-facing surface 188 of the plunger 182.

At a step 1120, the user aims the barrel 160 of the water balloon launching cannon 100 at a target. For example, by swiveling the water balloon launching cannon 100 in its mounting base 178, as shown in FIG. 4, the user aims the barrel 160 of the water balloon launching cannon 100.

Figure 13:
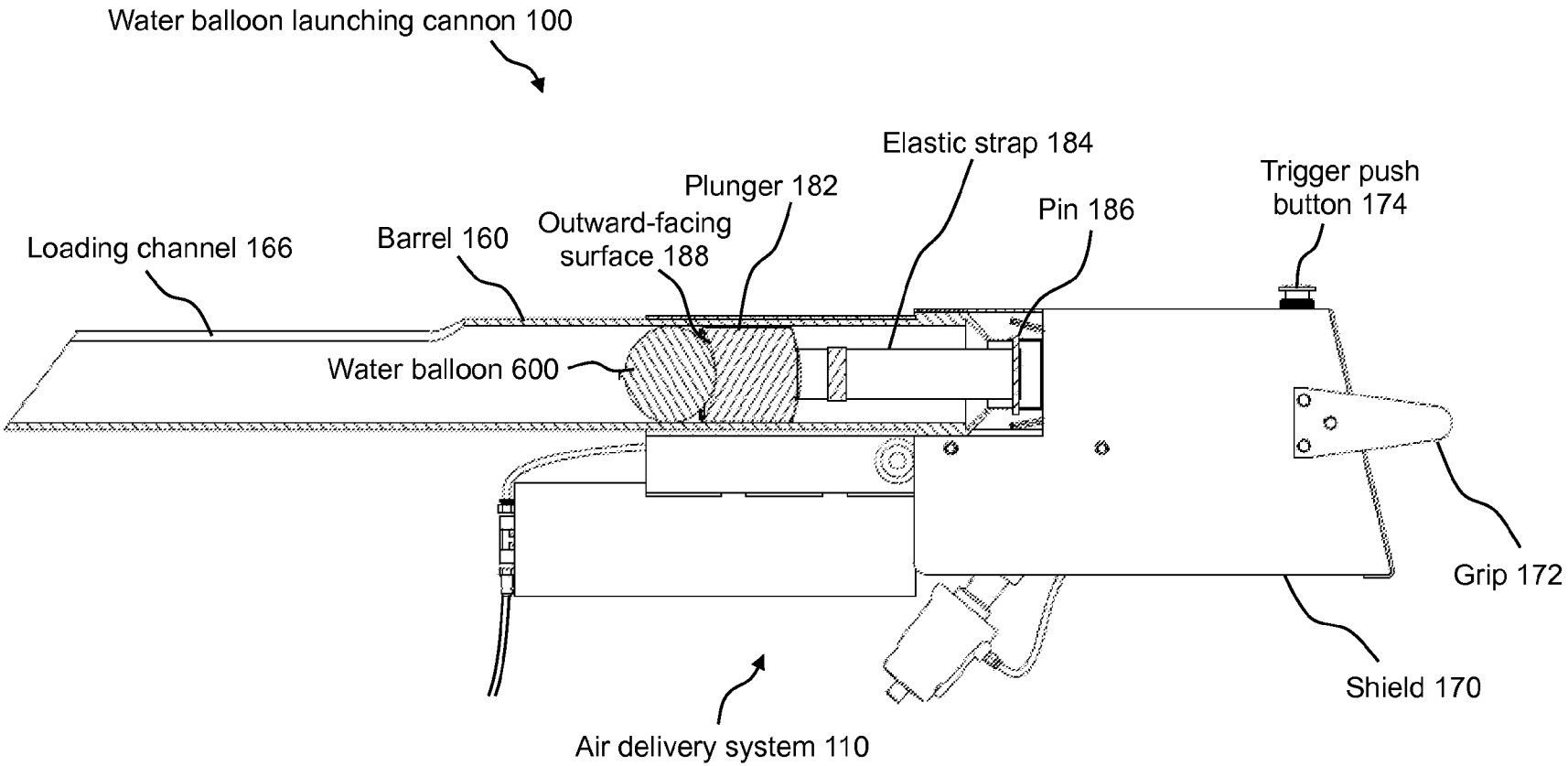
Figure 14:
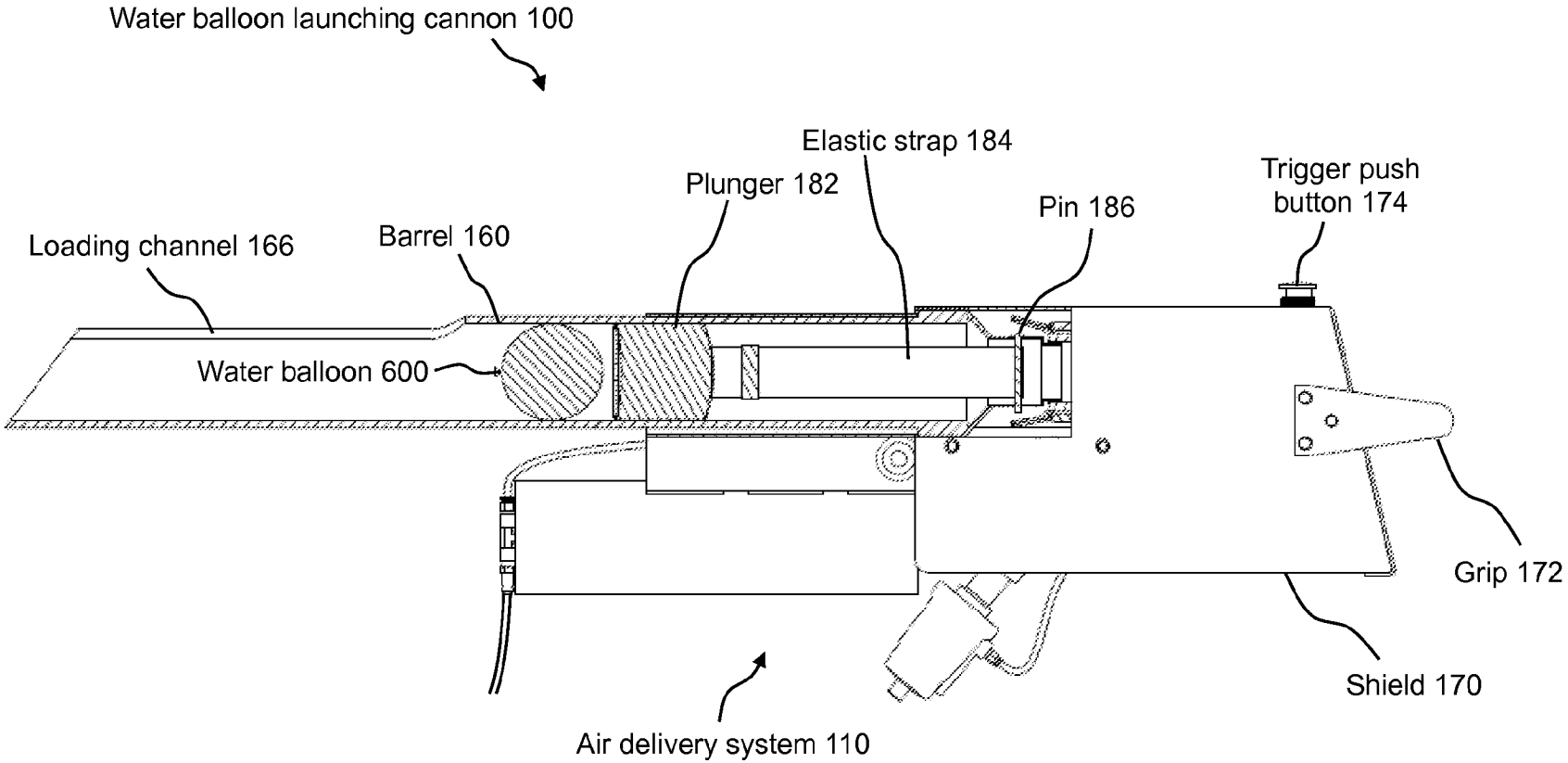
Figure 15:
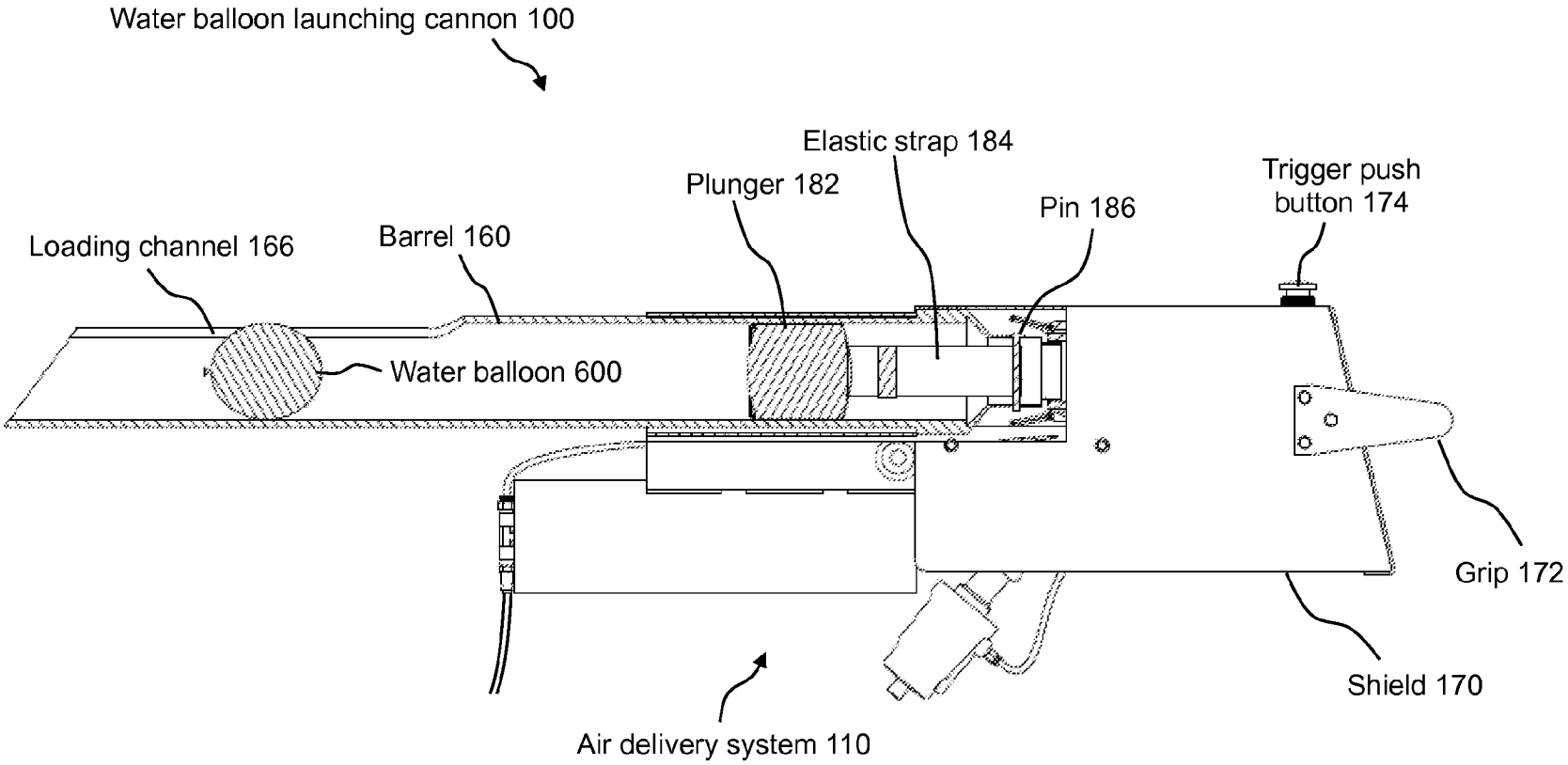
Figure 16:
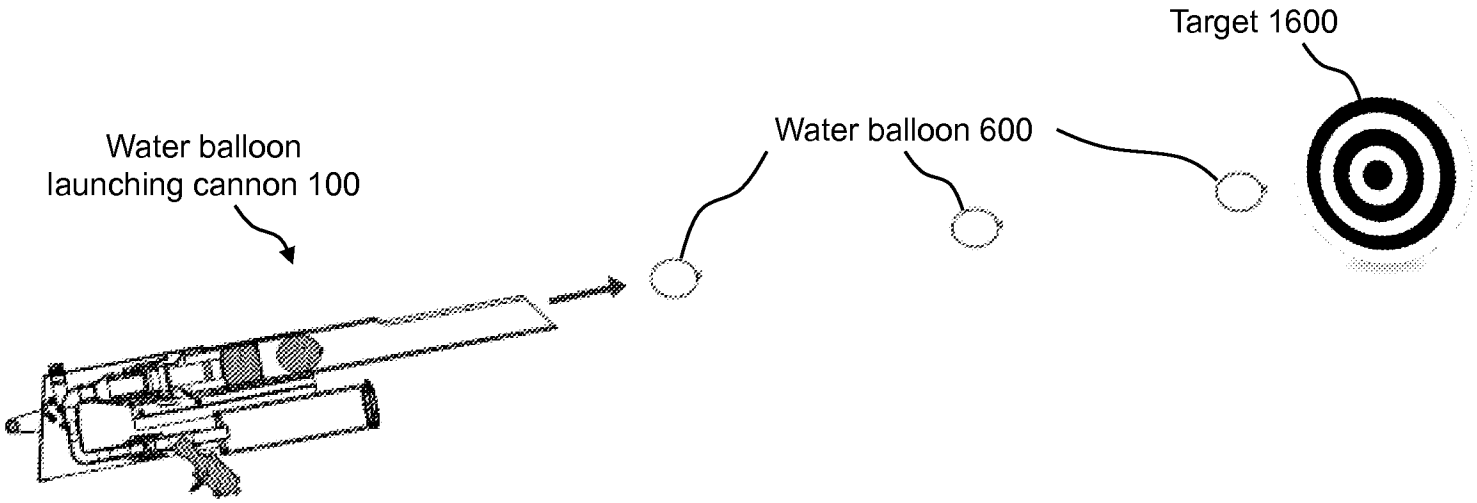
FIG. 16 illustrates a side view of the water balloon launching cannon firing a water balloon at a target that is some distance away.

At a step 1125, the user fires the water balloon launching cannon 100 by pressing the trigger push button 174 of the trigger 128 and launches a water balloon, such as the water balloon 600, toward its intended target. By way of example, FIGS. 13, 14, and 15 illustrate side views of the water balloon launching cannon 100 and show a process of launching a water balloon. Namely, FIG. 13 shows the beginning of the launching cycle in which the full impact of the plunger 182 is pressing against, for example, the water balloon 600. FIG. 13 shows that the outward-facing surface 188 of the plunger 182 deforms and is therefore able to conform to the shape of the water balloon 600, which minimizes the possibility of bursting the water balloon 600 upon impact. Referring now to FIGS. 14 and 15, once the stretching limit of the elastic strap 184 is reached the forward motion of the plunger 182 halts while the water balloon 600 continues to travel along and be propelled out of the barrel 160 due to the energy that is transferred to the water balloon 600 from the plunger 182. Continuing the example yet further, FIG. 16 illustrates a side view of the water balloon launching cannon 100 firing, for example, the water balloon 600 at a target 1600 that is some distance away.

The invention claimed is:

1. A water balloon launching apparatus, comprising:

a slotted barrel;

a plunger assembly disposed inside said slotted barrel, said plunger assembly having an outward-facing deformable surface;

said plunger assembly powered by compressed air for performing a launch cycle and launching a water balloon placed against said outward-facing deformable surface of said plunger assembly in said slotted barrel; and wherein said outward-facing deformable surface of said plunger assembly conforms to the shape of said water balloon during the launch cycle.

* * * * *